United States Patent [19]

Cenisio et al.

[11] Patent Number: 4,919,724

[45] Date of Patent: Apr. 24, 1990

[54] STABLE AQUEOUS EMULSIONS OF KETENE DIMER/NONREACTIVE HYDROPHOBE

[75] Inventors: Marco F. Cenisio, Milan, Italy; Vido J. Vareika, Newark, Del.

[73] Assignee: Hercules Incorporated, Wilmington, Del.

[21] Appl. No.: 297,650

[22] Filed: Jan. 17, 1989

[30] Foreign Application Priority Data

Jan. 18, 1988 [GB] United Kingdom ..... 88001004

[51] Int. Cl.[5] ..... D21D 3/00; C08L 3/00

[52] U.S. Cl. ..... 106/199; 106/201; 106/211; 106/212; 106/268; 162/158; 162/172; 162/179; 524/300; 524/487

[58] Field of Search ..... 162/158, 172, 179; 106/268, 212, 211, 199, 201; 524/300, 487

[56] References Cited

U.S. PATENT DOCUMENTS

| | | | |
|---|---|---|---|
| 4,017,431 | 4/1977 | Aldrich | 162/172 |
| 4,687,519 | 8/1987 | Trzasko et al. | 106/211 |
| 4,711,671 | 12/1987 | Mazzarella | 106/243 |

*Primary Examiner*—Theodore Morris

*Attorney, Agent, or Firm*—Ivan G. Szanto

[57] ABSTRACT

Stabilized aqueous emulsions of ketene dimer and non-reactive hydrophobe and method for sizing unbleached fibers and undigested wood chips for use in building products are provided.

13 Claims, No Drawings

STABLE AQUEOUS EMULSIONS OF KETENE DIMER/NONREACTIVE HYDROPHOBE

BACKGROUND OF THE INVENTION

1. Field of the Invention

The present invention relates to sizing agents and more particularly it relates to the sizing of cellulose fibers and wood chips with emulsions of ketene dimers and nonreactive hydrophobes.

2. Description of the Prior Art

Building products such as particle board and wafer board are made from mechanically chipped wood that is not digested and not bleached. Products such as paper, paperboard, and medium density fiberboard are made from cellulosic fibers that are produced by digestion of chipped wood. The cellulosic fibers may be bleached before being made into these products.

Cellulosic fibers and wood chips may need to be made to repel liquids in order to be successful in their final forms. Commonly, they need to repel inks or water, i.e. the fibers and wood chips need to be sized.

Over the years many types of sizing agent have been employed. The common sizing agents are based on rosins, ketene dimers, waxes, silicone resins or fatty acid derivatives. Each sizing agent has its advantages and disadvantages. Each sizing agent may advantageously be used under different conditions. The present invention relates to the sizing of cellulosic fibers and wood chips under neutral or alkaline conditions.

It is well known that alkyl (aryl, etc.) ketene dimers (AKD's) can be used successfully to size bleached pulp. AKD's are water insoluble and are therefore generally supplied as aqueous emulsions. These emulsions tend to be unstable, and it is therefore common practice to include stabilizers, such as starch derivatives, in particular cationic starch derivatives, in such emulsions. In this respect, reference is made for instance to U.S. Pat. No. 3,130,118 and U.S. Pat. No. 2,627,477. AKD's act by chemically reacting with the wood fibers in the pulp. In some circumstances the reaction can be relatively slow and therefore, in order to speed up the reaction, promoter resins can be added to AKD emulsions. Promoted AKD emulsions are available commercially.

Although in many applications AKD's are very useful in sizing pulp, they have certain drawbacks. In particular, AKD's work better with promoter resins in order to effectively size unbleached pulp. It has been conjectured that the reason for this is that the lignins and other chemical contaminants in unbleached pulp interfere with the reaction between the AKD and the fiber so that effective sizing is prevented.

Promoted AKD's are generally more effective in applications where a significant level of sizing is required before a size press, or before an on-machine coater or before an off-machine coater.

An alternative to AKD sizing in such applications is the use of nonreactive hydrophobes, such as waxes, hydrocarbon resins or terpene resins, added to the bleached or unbleached pulp, to give sizing in the body of the product, or used as a surface sizing agent. Hydrophobes such as wax are used also with wood chips in the manufacture of building products. The nonreactive hydrophobe does not react with the fibers or wood chips, but is present merely as a water repellent deposit on the fiber or wood chips. In order to obtain good sizing, a relatively large amount of nonreactive hydrophobe is required. However, this brings with it the disadvantage that the presence of the large quantity of nonreactive hydrophobe reduces the strength of the product. It is believed that this is because the hydrophobe interferes with the fiber interactions which contribute to the strength of the product.

This is of particular importance in building products where resins are added as binding age. 3. In these products, the extract pH may be approximately 5.5. The use of wax as the hydrophobe increases the slipperiness of the product, which is an advantage in the manufacture of building products, but is a disadvantage in paper and paperboard products.

A further problem with the use of wax as a sizing agent is that wax emulsions are generally unstable. There have therefore been a number of proposals for improving the stability of wax emulsions, for instance by the addition of emulsifying agents. In this respect, reference can be made, for instance, to U.S. Pat. No. 3,096,232.

The problem of wax emulsion stability is also addressed in U.S. Pat. No. 4,017,431. This patent discloses a stable aqueous wax emulsion. The stability of the emulsion is enhanced by blending either a fatty acid or an AKD with the wax and then using the blend to form a homogeneous dispersion of the blend in an aqueous medium. The medium preferably includes a stabilizing resin comprising an epoxy-terminated aminopolyamide. The patent shows the use of such homogeneous emulsions in the sizing of bleached pulp. The results given show an improvement in emulsion stability and a linear increase in sizing with increase in the AKD content of the blend. In view of the known adverse effect of lignins etc. on AKD sizing, it would be expected that the only part of such a blend which would be effective in sizing unbleached pulp would be the wax.

Japanese patent application J53 087395 (Kao Soap) also addresses the problem of slow development of sizing with AKD's by proposing mixtures containing AKD's and waxes dispersed together in water. Mixtures having ratios between 5–200 parts wax to 100 parts AKD, preferably 10–100 parts wax to .100 parts AKD, are disclsoed. Example 3 of this application shows that the rate of sizing development reaches a maximum at a ratio of about 5–10 parts wax to 100 parts AKD and that higher ratios of wax up to 100 parts wax to 100 parts AKD no not increase further the rate of development of sizing. This same Example shows also that the final level of sizing achieved after 1 day with these mixtures is not significantly higher than the level of sizing achieved by AKD alone.

It is an aim of the present invention to provide an improved method of and composition for sizing unbleached fibers for use in applications such as medium density fiberboard; and unbleached, undigested wood chips for use in the manufacture of particle board, wafer board and the like building products.

SUMMARY OF THE INVENTION

According to the present invention there is provided an aqueous emulsion comprising ketene dimer, nonreactive hydrophobe and stabilizer, said emulsion having a solids content of from about 5 to about 70% by weight and a ketene dimer to nonreactive hydrophobe ratio of from about 1:4 to about 1:166 by weight.

Further provided according to the present invention is a method of sizing cellulose fibers or wood chips comprising mixing the emulsion of the present invention with cellulose fibers or wood chips prior to forming them into products.

DETAILED DESCRIPTION OF THE INVENTION

It has surprisingly been discovered that the use of the emulsion of the present invention overcomes the disadvantages outlined above. The aqueous emulsion of the present invention comprises AKD and nonreactive hydrophobe as dispersed phases in an aqueous solution of stabilizer where the water is the continuous phase.

Generally the ratio (by weight) of AKD to nonreactive hydrophobe is from about 1:4 to about 1:166, preferably from about 1:6 to about 1:32. Most preferably the ratio is from about 1:8 to about 1:16.

The actual amount of solids present in the emulsion may vary from about 5 to about 70% by weight, preferably from about 20 to about 50%, and most preferably from about 25 to about 45% and will depend on the stabilizer used and the intended application of the emulsion. Preparing a suitable emulsion for any particular application will be a matter of routine experiment (given the teaching of this application) for one skilled in the art. The hydrophobes may be either premixed when molten prior to the addition of the stabilizer solution or they may be added molten but separately to the stabilizer solution.

The AKD which may be used as components of the present emulsion may be any of the known AKD's having the general formula $$[RCH{=}C{=}O]_2$$

wherein R is an alkyl radical which may be saturated or unsaturated having from 6 to 22 carbon atoms preferably from 10 to 20 carbon atoms and most preferably from 14 to 16 carbon atoms; a cycloalkyl radical having at least 6 carbon atoms or an aryl, aralkyl or alkaryl radical. These known AKD's are as described in U.S. Pat. No. 2,785,067. The AKD may be a single species or may contain a mixture of species.

Suitable AKD's include decyl, dodecyl, tetradecyl, hexadecyl, octadecyl, eicosyl, docosyl, tetracosyl cyclohexyl, phenyl and benzyl $\beta$ napthyl ketene dimers, as well as AKD's prepared from palmitoleic acid, oleic acid, ricinoleic acid, linoleic acid, linolenic acid, myristoleic acid and eleostearic acid or mixtures thereof.

The nonreactive hydrophobes which may be used in the emulsion of the present invention include both crude and refined paraffin waxes, hydrocarbon resins, terpene resins, synthetic waxes, naturally occurring waxes such as vegetable and animal waxes, e.g. beeswax, carnauba wax and montan wax, fatty acid amides e.g. bis-stearamide and mixtures thereof. The preferred hydrophobes are the crude and refined paraffin waxes and the most preferred hydrophobes are the crude paraffin waxes. Preferably, the synthetic wax has a molecular weight of from about 1500 to about 10,000, a density of from about 0.91 to about 0.94 g/cm$^3$ and a melting point below about 100° C.

Suitable stabilizers are e.g. starch, cationic starch, anionic starch, amphoteric starch, water soluble, cellulose ethers, polyacrylamides, polyvinyl alcohol, polyvinyl pyrrolidone (PVP) or mixtures thereof. It is to be expected that any stabilizer known in the art will be suitable in some of the applications envisaged. Preferred stabilizers are starch, cationic starch and PVP and the most preferred stabilizers are the cationic starches. The amount of stabilizer used will depend on the solids content of the emulsion necessary for any particular application, but can be readily determined by routine experiment by a person skilled in the art. Generally the stabilizer will be present in an amount of from about 1 to about 30% based on the weight of AKD/hydrophobe, preferably from about 3 to about 20% and most preferably from about 5 to about 10%.

The emulsion of the present invention may also include other additives commercially used in the art, such as promoter resins for the AKD's, biocides, etc.

Typically, the emulsions of this invention are made by melting the wax at abbout 75° C., melting the AKD at about 65° C. and either blending these together or using them separately as below. Cationic starch at 4.15% solids and sodium lignin sulphonate (SLS) at 0.85% solids are cooked in water at pH 5.5 for 15 minutes at 98° C. Either the molten blend as above or the two molten components are added to the starch emulsion. This is homogenized, cooled and the solids adjusted to 30% by weight by addition of water. The pH is 3–4.

The present invention also provides a method for sizing cellulose fibers or wood chips which comprises mixing the emulsion of the present invention with the fibers or wood chips prior to forming them into products.

The emulsion may be added at any suitable stage in the manufacture of the fiber or wood chip product. Preferably, the emulsion is added at as late a stage as possible.

It has been shown that the AKD effects a synergistic sizing action with the nonreactive hydrophobe when applied as the emulsion. More specifically, it has been shown that the AKD and the nonreactive hydrophobe act synergistically such that their combined sizing effect is significantly greater than the sum of their individual sizing effects.

The ability to use an AKD sizing agent in combination with wax brings with it the advantage that the amount of wax that needs to be used to achieve good sizing is reduced. Thus, when used in chipboard, the board strength will not be decreased to the same extent as for a similar product containing only wax as the sizing agent. Further, the replacement of wax by emulsions of this invention improves the "paintability" of fiberboard, i.e. the paint drying time is reduced and the surface quality is improved due to there being no wax spots. When used in paper or paperboard products, a higher level of sizing is achieved than would be expected from the level of AKD used. This is shown by the extraction tests set out in Example 5.

The present invention is now described by way of illustration only, with reference to the following examples. All parts and percentages are by weight unless otherwise specified and "HST" denotes the Hercules Sizing Test.

In the HST test, a sheet of sized paper is laid onto a solution containing by weight 1% of formic acid and 1.2% of Nnaphthol Green B. The reflectance of the paper is measured initially and is then monitored as it falls due to ink penetration into the paper. The HST time (in seconds) is the time taken for the reflectance to fall to 80% of its initial value. It can thus be seen that the larger the HST value, the better is the sizing.

EXAMPLES 1 AND 2 AND COMPARATIVE EXAMPLES 1 TO 3

In these Examples handsheets were made using a pulp containing 33% of groundwood and 67% of Kraft pulp (solids basis) in conventional fashion. The pulp was an unbleached pulp containing lignins, etc. In all cases, the appropriate emulsion was added to the pulp before formation of the sheet. The sheets were then tested for degree of sizing off-machine. The results are shown in Table I below.

TABLE I

| Ex. No. | Sizing Agent | Dry Basis Addition(1) Wax % | AKD % | Total % | O.M. HST(2) |
|---|---|---|---|---|---|
| C-1 | Wax Emulsion(3) | 0.75 | 0 | 0.75 | 80 |
| C-2 | Emulsion I(4) | 0 | 0.18 | 0.18 | 59 |
| C-3 | Emulsion II(5) | 0 | 0.17 | 0.24 | 131 |
| 1 | Emulsion III(6) | 0.75 | 0.09 | 0.84 | 288 |
| 2 | Emulsion IV(7) | 0.75 | 0.18 | 0.93 | 437 |

(1)The dry basis additions comprise the weight percentage of the active ingredient(s) added in the finished sheet. For Emulsion II this includes in the total the amount of promoter resin used.

(2)Hercules Size Test, as described above.

(3)Based on starch stabilized G grade fully refined paraffin wax.

(4)6% ketene dimer emulsion stabilized with starch where the AKD is obtained from a 1:1 mixture of $C_{16}$ and $C_{18}$ fatty acids.

(5)5.7% ketene dimer emulsion stabilized with starch where the AKD is obtained from a 1:1 mixture of $C_{16}$ and $C_{18}$ fatty acids and additionally containing 2.3% of promoter resin obtained by the reaction of dicyandiamide with formaldehyde.

(6)25% of wax as in C-1 and 3% of AKD as in C-2.

(7)25% of wax as in C-1 and 6% of AKD as in C-2.

The off-machine HST value for sheets sized with Emulsion III, containing 0.75 of wax and 0.09 of AKD, is 288. The value for sheets containing 0.75 of wax alone is 80. Assuming that the actions of the wax and AKD are independent, it would be expected that use of the 0.09% of AKD alone would give an HST value of 288–80=208. However, sheets sized with Emulsion I, containing 0.18% of AKD, twice that in Emulsion III-containing sheets, only have an HST value of 59. It is believed that this shows that there is surprisingly a synergistic effect between the wax and the AKD.

It can be seen from the data for Emulsion IV that increasing the amount of AKD relative to wax further improves the sizing effect. The Emulsion IV formulation could be used but at a lower rate of addition to achieve efficient sizing with a lower addition of wax. The data also show that using a preblend of 0.75% of wax with 0.18% of wax with 0.18% of AKD results in a far higher off-machine level of sizing than would be anticipated from the use of these components separately.

EXAMPLES 3 AND 4 AND COMPARATIVE EXAMPLES 4 AND 5

The synergism shown by the blend of the present invention is further illustrated by comparing the off-machine HST achieved with Emulsion III with the off-machine HST obtained from the separate additions of the wax emulsion and Emulsion I. The surprising synergism achieved by preblending the AKD and wax is demonstrated by the results in Table II obtained with 65 grams per square meter paper using a 33/67% bleached groundwood/Kraft pulp furnish.

TABLE III

| Ex. No. | Sizing Agent | Dry Basis Addition(1) Wax % | AKD % | Total % | O.M. HST(2) |
|---|---|---|---|---|---|
| 4 | Emulsion III | 0.75 | 0.09 | 0.84 | 353 |
| C-5 | Emulsion I+ Wax Emulsion | 0.75 | 0.09 | 0.84 | 240 |

Similar results are shown for a 100% bleached Kraft pulp furnish in Table III.

TABLE II

| Ex. No. | Sizing Agent | Dry Basis Addition(1) Wax % | AKD % | Total % | O.M. HST(2) |
|---|---|---|---|---|---|
| 3 | Emulsion III | 0.75 | 0.09 | 0.84 | 251 |
| C-4 | Emulsion I+ Wax Emulsion | 0.75 | 0.09 | 0.84 | 190 |

EXAMPLE 5 AND COMPARATIVE EXAMPLES 6 AND 7

Further evidence of the synergistic effect of the AKD and wax is provided by solvent extraction data on 65 grams per square meter paper using a 33/67% bleached groundwood/Kraft pulp furnish. Sheets sized as set out above with wax emulsion Emulsion I and Emulsion III were tested for natural HST value before and after soxhlet extraction for three hours using carbon tetrachloride as the solvent. Sheets sized with Emulsion III had an HST value reduced from 724 to 631. Sheets sized with Emulsion I had an HST value increased from 530 to 621 (probably brought about by curing of an AKD during extraction). The results are shown in Table IV.

TABLE IV

| Ex. No. | Sizing Agent | Dry Basis Addition Wax % | AKD % | Before Extraction HST | After Extraction HST | % Extract |
|---|---|---|---|---|---|---|
| 5 | Emulsion III | 0.75 | 0.09 | 724 | 631 | 0.5150 |
| C-6 | Emulsion I | 0.00 | 0.18 | 530 | 621 | 0.0542 |
| C-7 | Wax Emulsion | 0.54 | 0.00 | 166 | 0.2 | 0.4490 |

The extraction of the Emulsion III-sized sheets removed practically only wax from the sheet, but none of the bound AKD. The extraction of the Emulsion I-sized sheets also resulted in no extraction of bound AKD but did extract unbound AKD and ketone. It is therefore surprising that the Emulsion III-sized sheets, containing half the amount of AKD than the Emulsion I-sized sheet, retain a natural HST value substantially the same as that for the Emulsion I-sized sheet after extraction.

EXAMPLE 6 AND COMPARATIVE EXAMPLE 8

An emulsion of this invention was tested against a commercial wax emulsion in the manufacture of particle board. A wood furnish of 85% pine and 15% spruce was used on a conventional dry process commercial particle board machine of the discontinuous type. The wood chips, premixed with resin, hardener and sizing emulsion were formed into a board and leaded singly into a vertical press. When loaded, pressures of 50–70 kg/sq cm and temperatures of 180°–200° C. were applied for about 3 minutes. The boards were unloaded and allowed to acclimatize before being tested. All machine parameters and all other additives were kept constant. The results summarized in Table V show that the off-machine 24 hour water swell and water absorption figures (after a period to allow for stabilization) were slightly higher when using the wax/AKD emulsion. However, after 3 days of aging at ambient temperature, the 24 hour water swell and water absorption figures for the wax/AKD emulsion were better than those for the wax emulsion which was not expected to improve. The internal bond strength of the board made with the wax/AKD emulsion was higher than that made with the wax emulsion although the density of the board was lower.

TABLE V

| Ex. No. | (1) Wax % Dry Base | (2) AKD % Dry Base | Density Kg/m$^3$ | Internal Bond M Pa | Off-Machine Water Swell % | Off-Machine Water Absorption % | 3-Day Aged Water Swell % | 3-Day Aged Water Absorption % |
|---|---|---|---|---|---|---|---|---|
| C-8 | 0.5 | — | 645 | 0.39 | 9.02 | 54.64 | — | — |
| 6 | 0.25 | 0.03 | 627 | 0.42 | 12.15 | 63.83 | 6.10 | 45.30 |

EXAMPLES 7 AND 9 AND COMPARATIVE EXAMPLES 9 TO 11

An emulsion of this invention was tested against a commercial wax emulsion in the manufacture of medium density fiberboard. A wood furnish of 50% spruce and 50% pine was defibered, refined and blended with urea formaldehyde resin and sizing emulsion. This prepared furnish was used on a conventional dry, discontinuous type of machine used for the commercial production of medium density fiberboard. The formed boards were loaded singly into a vertical press. When full, pressure and a temperature of 170° C. were applied for 4 minutes. The boards were removed and allowed to acclimatize before being sanded and then tested. The wax and AKD in Examples 7 to 9 and Comparative Examples 9 to 11 were the same as the ones used in Example 6 and Comparative Example 8. All machine parameters and all other additives were kept constant. The results summarized in Table VI clearly show the synergistic action of the wax and AKD together in that lower total solids of the mixture compared to wax alone resulted in lower water absorption and water swell figures and a reduction in paint drying times. The paint drying time was reduced from 5 minutes with wax alone to 3 minutes with wax/AKD mixtures.

TABLE VI

| Ex. No. | Wax % Dry Base | AKD % Dry Base | Caliper mm | Water Absorption % | Water Swell % |
|---|---|---|---|---|---|
| 7 | 0.3 | 0.036 | 18 | 10.08 | 2.62 |
| C-9 | 0.6 | — | 18 | 12.9 | 3.2 |

Emulsions of this invention were tested against a commercial wax emulsion in the manufacture of medium density fiberboard. The amounts used and the results obtained are summarized in Table VII. The results on the board clearly show the improved properties obtained from the use of emulsions of this invention as compared to the properties obtained from the use of wax emulsions alone, both used at the same day basis addition levels.

TABLE VII

| Ex. No. | Wax % Dry Base | AKD % Dry Base | Caliper mm | Water Absorption % | Water Swell % |
|---|---|---|---|---|---|
| 8 | 0.661 | 0.079 | 12 | 12.1 | 4.8 |
| C-10 | 0.740 | — | 12 | 20.0 | 5.9 |
| 9 | 0.420 | 0.050 | 22 | 9.1 | 2.2 |
| C-11 | 0.470 | — | 22 | 10.5 | 2.6 |

It will be appreciated that the present invention has been described above by way of illustration only and that variations of details can be made without departing from the scope of the present invention.

We claim:

1. An aqueous emulsion comprising (a) ketene dimer having the general formula $$[RCH{=}C{=}O]_2$$

wherein R is an alkyl radical having from 6 to 22 carbon atoms, a cycloalkyl radical having at least 6 carbon atoms, an aryl, aralkyl or alkaryl radical;

(b) nonreactive hydrophobe is selected from the group consisting of crude and refined paraffin waxes, hydrocarbon resins, terpene resins, synthetic waxes, naturally occurring waxes, fatty acid amides and mixtures thereof; and (c) stabilizer selected from the group consisting of starch, cationic starch, anionic starch, amphoteric starch, water soluble cellulose ethers, polyacrylamides, polyvinyl alcohol, polyvinyl pyrrolidone and mixtures thereof.

2. The emulsion of claim 1 wherein the ketene dimer is selected from dimers wherein R is an alkyl radical having from 10 to 20 carbon atoms and mixtures thereof.

3. The emulsion of claim 1 wherein the solids content of the emulsion is from about 20 to about 50% by weight, the stabilizer level is from about 3 to about 20% based on the weight of ketene dimer/nonreactive hydrophobe and the ketene dimer to hydrophobe ratio is from about 1:6 to about 1:32.

4. The emulsion of claim 1 wherein the nonreactive hydrophobe is selected from the group consisting of crude and refined paraffin waxes.

5. The emulsion of claim 1 wherein the stabilizer is selected from the group consisting of starch, cationic starch and polyvinyl pyrrolidone.

6. The emulsion of claim 2 wherein the nonreactive hydrophobe is selected from the group consisting of crude and refined paraffin waxes, the stabilizer is selected from the group consisting of starch, cationic starch and polyvinyl pyrrolidone, the solids content of the emulsion is from about 20 to about 50% by weight, the stabilizer level is from about 3 to about 20% based on the weight of ketene dimer/nonreactive hydrophobe and the ketene dimer to hydrophobe ratio is from about 1:6 to about 1:32.

7. The emulsion of claim 6 wherein the ketene dimer is selected from dimers wherein R is an alkyl radical having from 14 to 16 carbon atoms and mixtures thereof.

8. The emulsion of claim 6 wherein the nonreactive hydrophobe is selected from the group consisting of crude paraffin waxes.

9. The emulsion of claim 6 wherein the stabilizer is cationic starch.

10. The emulsion of claim 6 wherein the solids content of the emulsion is from about 25 to about 45% by weight, the stabilizer level is from about 5 to about 10% based on the weight of ketene dimer/nonreactive hydrophobe and the ketene dimer to hydrophobe ratio is from about 1:8 to about 1:16.

11. The emulsion of claim 7 wherein the nonreactive hydrophobe is selected from the group consisting of crude paraffin waxes, the stabilizer is cationic starch, the solids content of the emulsion is from about 25 to about 45% by weight, the stabilizer level is from about 5 to about 10% based on the weight of ketene dimer/-nonreactive hydrophobe and the ketene dimer to hydrophobe ratio is from about 1:8 to about 1:16.

12. Method of sizing unbleached cellulose fibers or undigested wood chips comprising mixing the emulsion of claims 1, 2 6 or 11 with the cellulose fibers or wood chips prior to forming them into building products.

13. The method of sizing unbleached cellulose fibers or undigested wood chips comprising mixing the emulsion of claims 1, 2, 6 or 11 with the cellulose fibers or wood chips at as late a stage as possible prior to forming them into building product.

* * * * *